United States Patent [19]

Rausing

[11] 4,364,220

[45] Dec. 21, 1982

[54] CONTAINER INTENDED FOR CONTENTS UNDER PRESSURE TOGETHER WITH A METHOD FOR THE MANUFACTURE OF SUCH A CONTAINER

[75] Inventor: Hans A. Rausing, Lund, Sweden

[73] Assignee: Tetra Pak International AB, Sweden

[21] Appl. No.: 184,885

[22] Filed: Sep. 8, 1980

[30] Foreign Application Priority Data

Sep. 12, 1979 [SE] Sweden ..... 7907560

[51] Int. Cl.[3] ..... B65B 9/06; B65B 47/04; B65B 61/02

[52] U.S. Cl. ..... 53/411; 53/453; 53/454; 53/482; 53/484; 53/451

[58] Field of Search ..... 53/411, 451, 450, 453, 53/482, 550, 551, 552, 454, 484, 560; 493/295, 302; 426/410

[56] References Cited

U.S. PATENT DOCUMENTS

| | | | |
|---|---|---|---|
| 1,402,293 | 1/1922 | Heist | 53/450 X |
| 2,248,471 | 7/1941 | Stroop | 53/451 X |
| 2,718,105 | 9/1955 | Ferguson | 53/450 X |
| 3,039,905 | 5/1962 | Weintraub | 53/482 |
| 3,048,951 | 8/1962 | Oler | 53/451 |
| 3,282,411 | 11/1966 | Jardine | 53/482 |
| 3,466,836 | 9/1969 | Pratt | 53/450 |
| 3,782,066 | 1/1974 | Schmitt | 53/453 X |
| 3,800,497 | 4/1974 | Pearson | 53/411 |
| 3,904,166 | 9/1975 | Wadsworth | 53/550 X |
| 4,232,048 | 11/1980 | Palm | 426/406 X |

FOREIGN PATENT DOCUMENTS

| | | | |
|---|---|---|---|
| 780291 | 7/1957 | United Kingdom | 53/453 |
| 1476636 | 6/1977 | United Kingdom | 426/410 |

*Primary Examiner*—John Sipos

*Attorney, Agent, or Firm*—Burns, Doane, Swecker & Mathis

[57] ABSTRACT

The invention relates to a sheet metal container adapted so that it can withstand an internal pressure. The container comprises two combined shell-shaped cavities, compression-moulded from the same web which cavities are brought together as the web is doubled along pre-impressed folding lines in two steps, namely a first step wherein the longitudinal edges of the web are joined together to form a tube of an elongated, substantially triangular cross-section, and a second step when the tube formed, after the contents have been introduced, is pressed flat and is sealed around the shell-shaped cavities. Finally the web is cut or punched around the hollow bodies formed by the shell-shaped portions to form a flange, closed in itself, which flange is folded down or beaded.

8 Claims, 9 Drawing Figures

CONTAINER INTENDED FOR CONTENTS UNDER PRESSURE TOGETHER WITH A METHOD FOR THE MANUFACTURE OF SUCH A CONTAINER

BACKGROUND AND SUMMARY OF THE PRESENT INVENTION

The present invention relates to a container intended for contents under pressure and comprising a liquid and a gas. The invention also relates to a method for the manufacture of such a container.

Pressurized products, such as e.g. beer and refreshing beverages, are packed in most cases in glass bottles or in sheet metal drums. Both of these types of packages are relatively expensive to manufacture and, moreover, have the disadvantage that the containers must be filled individually, which means that they cannot be filled completely, but that an air pocket is formed in each packing container. These air pockets not only mean that the volume of the package cannot be fully utilized, but in most cases also a detrimental effect on the packed product is exercized by the oxygen of the air enclosed in the packing container acts as an oxidant. Since filled containers of the type mentioned here often have long storage time the oxygen gas enclosed in the container is liable to oxidize the flavor substance of the packed product. Consequently, the quality of the product deteriorates.

Thus a need exists for an inexpensive and wholly filled package for pressurized contents, and in the following specification a container will be disclosed which can satisfy this need. The container in accordance with the present invention is characterized by two compression-moulded shell-shaped parts of sheet metal facing one another and being joined to one another. Both parts are moulded from one and the same sheet and both have plane flanges around the moulded shell-shaped portions. The insides of the said parts are provided with a thermoplastic lining by which the flanges are sealed to one another in a first sealing joint. The flanges moreover are joined to one another mechanically in a second sealing joint in that the flanges sealed to one another are folded down against and sealed to the moulded parts of the container and/or rolled together or beaded together under pressure.

The invention also relates to the method of manufacturing a container in accordance with the invention. The method is characterized in that a web of sheet metal, e.g. sheet iron (black sheet), which at least along one of its sides is covered with a thermoplastic lining, e.g. polyethylene, polypropylene or polyester, is provided with at least two folding indications along the central portion of the web. The indications are parallel with the web and with each other and the areas of the web on both sides of the folding indications are compression-moulded with simultaneous stretching of the moulding material to obtain shell-shaped cavities situated right opposite one another on the web. The web is folded along the folding lines in such a manner that its non-moulded edge zones are brought together and sealed to each other by surface melting of the thermoplastic lining of the web within the joined edge zones, thus forming a tube of triangular cross-section, the compression-moulded shell-shaped cavities facing one another in pairs. The contents are introduced into the tube formed by a filler pipe passed into the tube, and that, after filling, the tube is fully pressed together and sealed along the non-moulded portions. The tube is divided up into individual containers by cutting or punching through the web in the area between successive containers, and the flanges around the filled cavity of the container are folded in against the container body, rolled or beaded.

BRIEF DESCRIPTION OF THE DRAWINGS

An embodiment of the invention will be described in the following with reference to the enclosed schematic drawing, wherein like members bear like reference numerals and wherein.

DETAILED DESCRIPTION OF THE PREFERRED EMBODIMENTS

Figure 1:
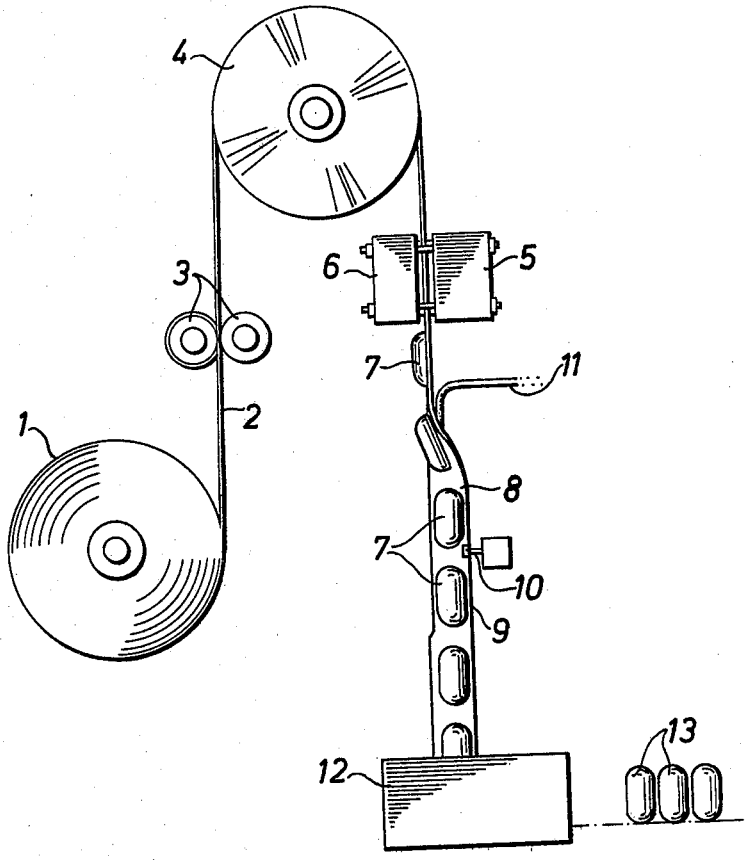
FIG. 1 is a diagrammatic sketch of a packing machine for the manufacture of containers in accordance with the invention.

A packing machine (shown in FIG. 1) comprises a magazine roll 1 of weblike material, preferably sheet metal of the relatively soft and inexpensive quality which is known under the trade description "black sheet". From the magazine roll 1 the sheet web 2 is rolled off and passes between scoring rollers 3, by means of which longitudinal embossings facilitating the folding are provided in the web 2. The web 2 provided with longitudinal folding embossings is passed over a guide roll 4 of a relatively large diameter in order to prevent buckling in the sheet material. The web 2 is introduced subsequently between two co-operating moulding elements 5, 6 which press shell-shaped cavities 7 into the web 2.

After the compression moulding of the web, the web is folded to a "tube" 8 of an elongated, preferably triangular cross-section, in a manner described in more detail in the following, whereupon the longitudinal edges 9 of the web 2 are joined to one another by heat-sealing of a thermoplastic lining applied to the web. This heat-sealing is carried out with the help of sealing devices 10 which may be constituted, for example, of co-operating pressure rollers, which are adapted so that the rollers take up between them the web edges 9, and of elements for the local heating of the thermoplastic layer on the edge zones 9 of the web 2. The tube formed is filled with the intended contents, which are introduced through a filler pipe 11 in such a manner that the compression moulded shell-shaped portions facing one another are filled with contents. Thereafter, the web is pressed flat completely and the non-moulded portions around the shell-shaped parts are heat-sealed to each other by pressure and sealing elements 12. Finally the containers formed by the shell-shaped portions facing one another are punched out or cut out of the web such that the container space formed is surrounded by a flange closed in itself. The flange is folded down against and is sealed to the outside of the container or alternatively is rolled or beaded to form a mechanically resistant joint which is capable of absorbing the stresses which emanate from the internal pressure.

Following the above general basic description of a packing machine for the manufacture of containers in accordance with the invention, the invention will now be described in greater detail.

Figure 2:
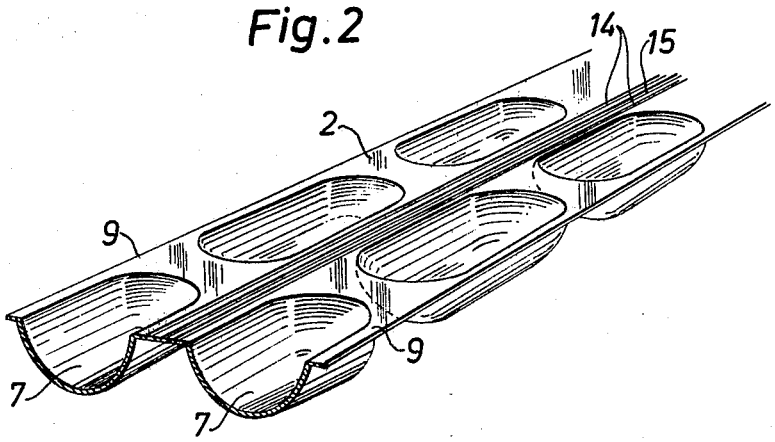
FIG. 2 is a perspective view of a compression moulded material web, cut through longitudinally.

With reference to FIG. 2 the sheet web 2 is provided on the one hand with scores 14, 15 facilitating the folding of the web, and on the other hand with shell-shaped cavities 7. The longitudinal scores 14, 15 are produced by the co-operating scoring rollers 3 shown in FIG. 1, one of which has projecting ridgelike features and the other has corresponding recesses so that the sheet as it passes between the rollers will be locally deformed to produce a folding indication.

The folding indication line 15 is located preferably at the centre line of the web 2, while the folding indication lines 14 are arranged on either side of and parallel with the folding indication line 15 located in the middle between the folding indication lines 14. In the stamping of the folding indication lines 14, 15 it may be advantageous to dimension the stampings so that the folding indication lines 14 are given a harder stamping so that it will be easier to fold the sheet about the folding indication lines 14 than about the folding indication line 15.

The shell-shaped cavities 7 are produced by compression moulding with simultaneous deformation and stretching of the sheet web 2 within the region of the web where the shell-shaped cavities 7 are to be located. The parts of the web 2 located around the cavities are therefore held tight during the moulding work in such a manner that no stretching or other deformation of the held parts can occur. To prevent excessive stresses in the sheet web, especially at the transition between worked and unworked area of the web, the moulding may be carried out in two steps, the first moulding step being performed in such a manner that the central portion of the shell-shaped cavity is formed, while in the second moulding operation the whole area of the web which is to be subjected to compression moulding is pressed to its ultimate shape 7.

The compression moulding may be carried out advantageously for example with the help of an eccentric press. The parts of the web 2 intended for moulding are pressed down by an upper die, which has a shape corresponding to the inner contour of the cavity, into a lower die which has a shape and size corresponding to the outer contour of the compression moulded portion. The compression moulding thus takes place through a stretching and redistribution of the material which at the same time is thinned out without a formation of wrinkles taking place in the moulded portions to any appreciable extent.

Figure 3:
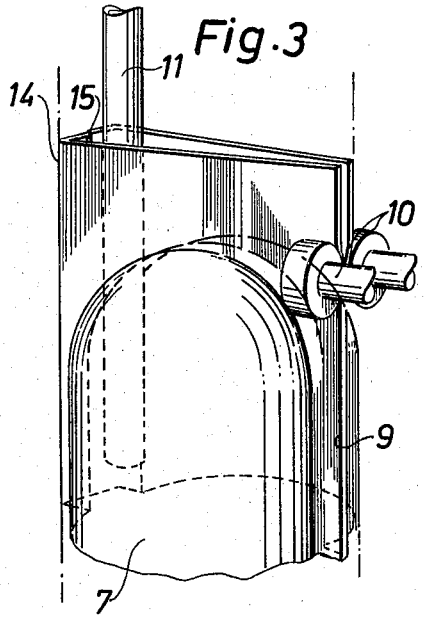
FIG. 3 is a perspective view of a tube formed by the moulded material web.
Figure 4:
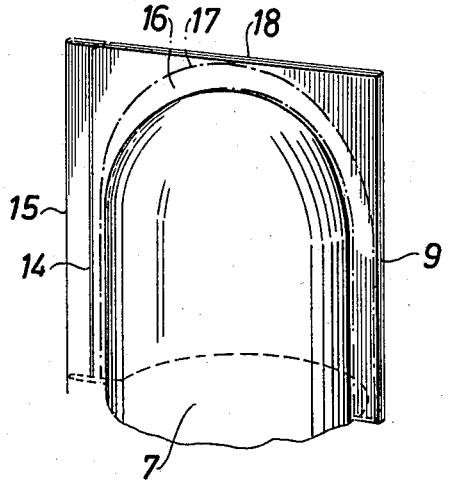
FIG. 4 is a perspective view of a container formed by double-folding of the web.

With reference to FIG. 3 the moulded web in accordance with FIG. 2 is folded together about the crease lines 14 in such a manner that the edge zones 9 of the web 2 will coincide. Since no folding takes place along the folding indication line 15, the web will be converted to a "tube" of an elongated, substantially triangular cross-section. Since the inside of the web 2 is provided with the lining of thermoplastic material the edges 9 of the web 2 can easily be joined together by heating the plastic material in the edge zones and then pressing together between the pressure rollers 10 so that melting together on the surface of the plastic layers is obtained. The heating of the plastic layers may take place in a manner not shown here in that hot air is blown onto the edge zones of the web 2 or the edge zones are locally heated, e.g. by a high-frequency electromagnetic field. Into the edge-sealed tube thus formed contents are applied through the filler pipe 11, the contents being supplied to such a level in the tube that the contents column extends over a number of divisions comprising the said shell-shaped cavities. In the folding together of the web 2 in accordance with FIG. 3 the moulded shell-shaped cavities 7 in the web will be facing towards each other and will be located directly opposite each other. After the tube has been filled with contents, which takes place continuously since the tube is formed through a continuous or intermittent movement, the tube is sealed off (FIG. 4). This sealing off, which takes place below the outlet of the filler pipe 11, is initiated by the tube being pressed flat in that the sides of the tube are pressed against each other. The material web is folded along the folding line indication 15, while the earlier folds along the folding line indications 14 are straightened out again. After the flattening of the web, at least parts of the portions of the non-moulded part of the web, facing one another and in contact with one another, are sealed together by heat-sealing the thermoplastic inside lining. The heat sealing may take place as a seal 16 closed in itself around the shell-shaped space 7, which means that the cavity of the container, which consists of two shell-shaped cavities 7 facing one another, will be completely filled with contents and that no air will be enclosed in the said cavity. For the trimming of the edge portions around the cavity formed the web is cut or punched around the cavity along the line 17 at the same time as the moulded and worked part of the tube is cut off or separated from the remaining parts of the tube along a line 18. The lower part of the tube at the same time is given a new closure.

Figure 5:
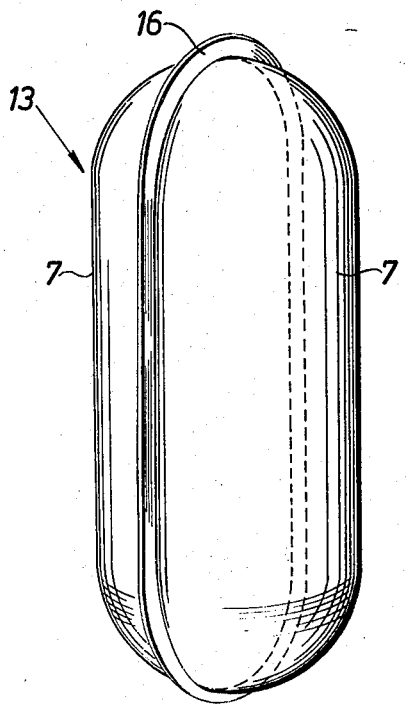
FIG. 5 is a perspective view of a container punched out from the web according to FIG. 4.

With reference to FIG. 5 a separated container 13 consists of the two shell-shaped cavities and the common flange 16 of the joined parts which projects at right angles from the surface of the container 13. Since it is assumed that the contents consist of a liquid wherein a gas, e.g. carbon dioxide, is dissolved, no pressure exists inside the container directly after the sealing. However, an internal pressure builds up relatively rapidly as gas dissolved in the liquid is released. The sealing joint which fastens the flanges 16 is not dimensioned to withstand the internal pressure which can be built up in the container 13. Therefore, the sealing joint between the flanges 16 is reinforced directly to prevent the sealing joint from being burst open when the pressure in the container 13 increases.

Figure 6:
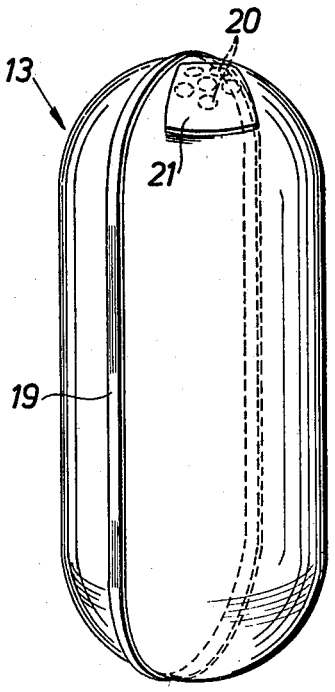
FIG. 6 is a perspective view of the container in accordance with FIG. 5 after folding down of the edge zone.
Figure 7:
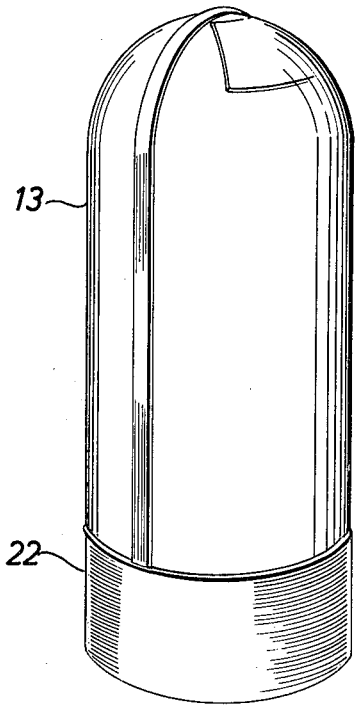
FIG. 7 is a perspective view of a packing container in accordance with FIG. 6 provided with a supporting skirt.

The sealing joint 16 can be strengthened in a number of different ways, the simplest of which comprises folding the flange down against the container body and sealed to the same e.g. by heat-sealing of a thermoplastic outer layer. It is also possible in a conventional manner to roll or bead the projecting flange 16 so as to form a mechanically strong bead 19 of the type which is shown in FIG. 6. In order to make the contents of the packing container 13 accessible, the container 13 must be provided with an emptying opening. In a preferred embodiment an emptying opening is proposed which consists of a group of small holes 20 situated closely to each other which are punched into the sheet web, this group of holes being covered collectively by a cover strip 21. Other forms of emptying openings are conceivable, but it has been found that an opening according to the proposal is inexpensive and easy to execute and functions well.

The ideal shape of the package in accordance with FIG. 6 is a sphere, but a cylindrical container body with two dished or semispherical ends is also conceivable. The disadvantage of such a container is that it cannot stand of its own accord when it is placed on a flat base. It is proposed therefore that an annular supporting skirt 22, e.g. of cardboard or plastics, should be fixed around one end of the container 13.

Figure 8:
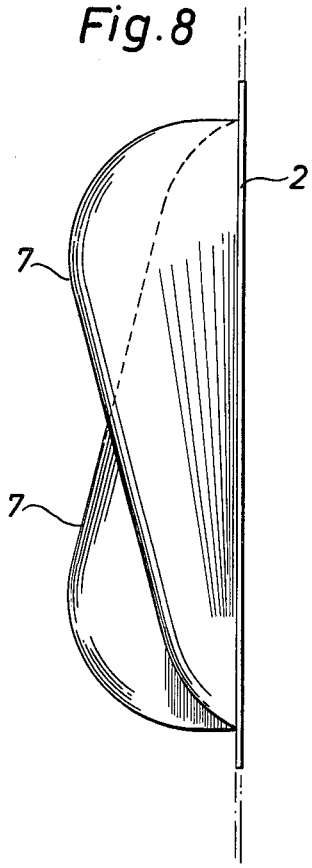
FIG. 8 is a side elevational view of a packing material web with asymmetrically pressed out shell-like cavities.
Figure 9:
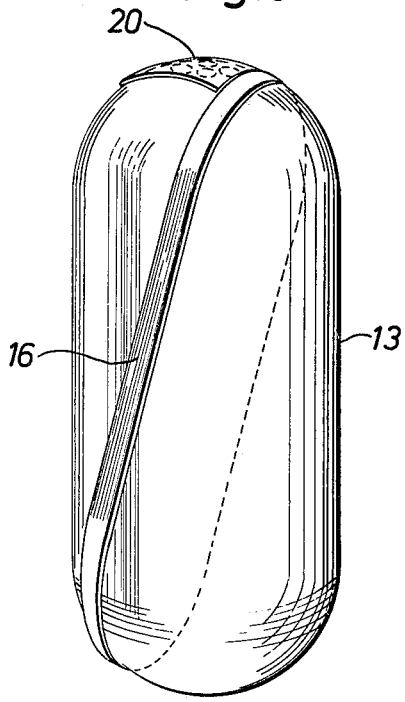
FIG. 9 is a perspective view of a packing container manufactured from a web which has been compression moulded in accordance with FIG. 8.

In the example described above the emptying opening 20 has to be located asymmetrically on the upper part of the container 13, since the folded down or beaded flange 19 runs over the central portion of the container 13. This can be avoided if the punching is carried out in the manner as shown in FIG. 8. As can be seen in FIG. 8, the moulded shell-shaped cavities 7 are not symmetrical, but the one end of the shell-shaped cavity is deeper than the other. Following the rest the manufacturing principle, as illustrated by FIGS. 2, 3 and 4, with associated parts of the description applied, it is found that the container 13 formed will be given a flange portion which generally runs diagonally over the container. Consequently the emptying hole 20 can be placed centrally.

As mentioned earlier it is assumed that the packing container is manufactured from a web of relatively soft iron plate, so-called black plate. The thickness of the web 2 naturally depends on the thickness of the containers 13 and may vary between 0.1 and 0.5 mm. Other web thicknesses are also conceivable in the manufacture of very small or very large containers 13.

The container of the type mentioned here is often provided with printed texts or pictures with information concerning the goods together with symbols and trade mark of the manufacturer. This text can be printed onto the flat sheet web 2, since it has been found that the decorative layer can be stretched together with the material during the moulding process without being destroyed. As the material onto which the text has been printed is subjected to a stretching, the pattern printed originally will be distorted, but since it has been found that the material in the web 2 stretches similarly in each moulding process, it is possible to take into account the said distortion of the printed pattern and print instead the pattern onto the plane web in so-called distorted print. In other words, the pattern in the original printing of the web is so distorted from the beginning that after compression moulding the pattern obtains the desired appearance.

It has been found that by application of the method in accordance with the invention, sheet metal containers can be manufactured of appreciably thinner material than that used at present in the manufacture of sheet metal drums. It is true that the thinner the metal sheets, the higher will be the cost charged per kilogram, but the rise in cost of the sheets is within reasonable limits not as sharp as the reduction in thickness, so that on principle it is economical to produce tins from as thin a sheet as is mechanically possible to use. Certain limitations in respect to the thickness of sheet are set by the strength of the beaded joint, and it has been found that it is difficult to obtain a beaded joint which is sufficiently strong if the sheet is too thin. However, it is possible to reinforce joints, even if the sheet metal in the joints were to be extremely thin. Such a method of reinforcing the joints or beads consists of sticking a pointed, driftlike tool through the beaded joints so that the sheet metal in the "entrance hole" of the drift will be pressed out, so that the sheet metal edge at the "exit point" projects in front of the sheet metal layer opposite the joint. After this "penetrating operation" the joint can be pressed together between pressure rollers so that a "riveting" of the pushed-through layer of sheet metal is obtained. This "pushing through" or "penetrating operation" can be carried out either on the flanges joined by heat sealing, which subsequently are folded down or beaded, or else on the joints already beaded, but not yet folded down. Another possibility that is available consists in welding together the joined flanges 16 by means of conventional spot or edge welding methods. As there is a risk of the heat developed in such an operation becoming too high for the contents, the latter method will be applicable only to a limited extent.

What may happen with a folded down or beaded joint in excessively thin material is that the joint may "rise" and subsequently be split open by the internal pressure in the container. This tendency towards "flange rise" is of course greater along the straight portions of the flange than along the curved ones, since "folding" the flange over a corner or a curved surface in a natural manner retains the flange in folded down position. It is reasonable therefore to concentrate the abovementioned measures for the prevention of "flange splitting" to the straight portions of the flange, i.e., the parts of the flange 16 which are located on the cylindrical portion of the container 13.

Up to now all sheet metal packages have been made in one manufacturing operation and filled and closed in a second operation. This involves considerable problems with regard to space and storage of empty packages and also entails appreciable transport costs. Moreover, empty containers are liable to mechanical damage and they easily collect dust and dirt during storage and transport. Owing to the bulky volume of the empty containers, it is necessary to plan production, contents and packages well ahead, so that containers of the right size and quality will be accessible for the production of a certain product. Since the material for the containers in accordance with the invention can be supplied in pre-printed rolls, transport and storage are facilitated and large sums can be saved at the same time as hygienic conditions are greatly improved. It is a further great economic advantage that the containers are manufactured simultaneously with the filling operation. Owing to the insides of the packages obtaining automatically a coating of plastic material, in that the weblike packing material is provided during manufacture with at least one internal coating of thermoplastics which may be extrusion coated, large amounts are saved since extrusion lamination is considerably cheaper than today's lacquering technology which is used in connection with conventional sheet metal tins. A further great advantage is that in extrusion coating all the solvents, controversial from a point of view of health, are avoided which form part of the lacquers with which today's metal tins are coated on the inside.

Through the application of the method in accordance with the invention it is thus possible to manufacture a container for pressurized contents much more cheaply than by conventional technology. Additional advantages are that the containers will be light and completely filled, which improves the chances of the contents maintaining their good quality.

The description given here is only intended to illustrate a possible embodiment of the invention and it is thus possible within the scope of the concept of the invention to modify the shape and the opening arrangement of the container and also to apply methods other than those described here for the compression moulding of the shell-shaped cavities, the sealing, cutting etc.

Accordingly, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A method for the manufacture of a container comprising the steps of providing at least two folding indication lines along a central portion of a web of sheet metal having at least one of its sides covered with a thermoplastic lining, said folding indication lines being parallel with a longitudinal axis of the web and with each other, compression moulding and simultaneously stretching areas of the web on each side of said folding indication lines to obtain shell-shaped cavities situated directly opposite one another on the web and surrounded by flanges, folding the web along said folding indication lines such that non-moulded longitudinal edge zones of the web are brought together, sealing said edge zones to each other by surface melting the thermoplastic lining of the web within the edge zones thereby forming a tube of elongated, triangular cross-section with the compression moulded shell-shaped cavities facing one another in pairs on opposite side walls of the triangular tube and a flat base of the triangular tube being formed between said folding indication lines, introducing contents into the tube through a filler pipe passed into the tube, pressing the side walls of the triangular tube together adjacent the base and downstream of the filler pipe after filling of the individual facing cavities to flatten said base to form a flat flange, subsequently sealing the tube along the flanges, dividing the tube into individual containers by cutting or punching through the web in the area between successive containers, and folding the flanges around the filled cavity of the container against the container body.

2. The method in accordance with claim 1, further comprising securing the joined flanges in the joined position by punching through the flanges such that at least one material layer on the side where the punch penetrates into the flanges is pressed in through the punched hole and projects to the opposite side of the flanges.

3. The method in accordance with claim 2, further comprising folding the at least one punched through material layer of the flanges back against the opposite side of the flanges whereby a rivet joint is obtained.

4. The method in accordance with claim 1, further comprising providing the web with a third folding indication line which is located along the center line of the web between said two folding indication lines to facilitate pressing the side walls of the tube together by folding along said third folding indication line.

5. The method in accordance with claim 1, further comprising providing decoration and text on the areas of the web intended for moulding prior to the compression moulding in distorted patterns, whereby said patterns achieve correct proportions after the moulding.

6. The method in accordance with claim 1, wherein the moulding is carried out by an eccentric press, the material in the area intended for moulding work being stretched and pressed into a lower die by a forming die.

7. The method in accordance with claim 6, wherein the moulding is carried out in two steps, the first moulding step being concentrated on a central portion of the moulding area, and the second moulding step being carried out on the entire moulding area.

8. The method according to claim 1, further comprising the step of rolling or beading the flanges prior to folding the flanges against the container body.

* * * * *